US005763129A

United States Patent [19]

Chen et al.

[11] Patent Number: 5,763,129

[45] Date of Patent: Jun. 9, 1998

[54] METHOD OF INCREASING GLOSS AND TRANSPARENCY CLARITY OF FUSED TONER IMAGES

[75] Inventors: Jiann H. Chen, Fairport; Borden H. Mills, III; Robert G. Scheidt, both of Webster, all of N.Y.

[73] Assignee: Eastman Kodak Company, Rochester, N.Y.

[21] Appl. No.: 692,162

[22] Filed: Aug. 1, 1996

[51] Int. Cl.[6] ..... G03G 13/20

[52] U.S. Cl. ..... 430/99; 430/97; 492/46; 492/56; 399/328; 399/330; 399/331; 399/333

[58] Field of Search ..... 430/99, 97; 492/46, 492/56; 399/328, 330, 331, 333

[56] References Cited

U.S. PATENT DOCUMENTS

| | | | |
|---|---|---|---|
| 3,132,123 | 5/1964 | Ferguson et al. | 260/87.5 |
| 3,874,894 | 4/1975 | Pedersen | 117/17.5 |
| 3,912,901 | 10/1975 | Strella et al. | 219/216 |
| 4,075,362 | 2/1978 | Concannon | 427/22 |
| 4,083,092 | 4/1978 | Imperial et al. | 29/132 |
| 4,149,797 | 4/1979 | Imperial | 355/3 FU |
| 4,179,601 | 12/1979 | Tarumi et al. | 219/216 |
| 4,196,256 | 4/1980 | Eddy et al. | 428/422 |
| 4,199,626 | 4/1980 | Stryjewski et al. | 427/444 |
| 4,272,179 | 6/1981 | Seanor | 355/3 FU |
| 4,329,565 | 5/1982 | Namiki et al. | 219/216 |
| 4,711,818 | 12/1987 | Henry | 428/421 |
| 4,763,158 | 8/1988 | Schlueter, Jr. | 355/3 FU |
| 4,791,447 | 12/1988 | Jacobs | 355/3 FR |
| 4,796,049 | 1/1989 | Taniguchi et al. | 355/3 FU |
| 4,813,868 | 3/1989 | Soga | 432/8 |
| 4,819,020 | 4/1989 | Matsushiro et al. | 355/3 FU |
| 4,905,050 | 2/1990 | Derimiggio et al. | 355/290 |
| 4,934,930 | 6/1990 | Soga | 432/60 |
| 4,935,785 | 6/1990 | Wildi et al. | 355/290 |
| 5,011,872 | 4/1991 | Latham et al. | 523/440 |
| 5,087,946 | 2/1992 | Dalal et al. | 355/285 |
| 5,187,849 | 2/1993 | Kobayashi | 29/492 |
| 5,248,339 | 9/1993 | Fitzgerald et al. | 118/60 |
| 5,258,256 | 11/1993 | Aslam et al. | 430/124 |
| 5,291,257 | 3/1994 | Cerrah et al. | 355/290 |
| 5,411,779 | 5/1995 | Nakajima et al. | 428/36.91 |
| 5,420,679 | 5/1995 | Goto et al. | 355/285 |

*Primary Examiner*—Mark Chapman
*Attorney, Agent, or Firm*—Doreen M. Wells

[57] ABSTRACT

This invention provides a method of increasing the gloss value of a fused toner image comprising the steps of:

a) transferring toner to a receiver to make a toner bearing receiver; and b) passing the toner bearing receiver through a heated fuser system to create a fused toner image on a receiver; wherein said heated fuser system consists of a fuser roller and a pressure roller; said fuser roller has a surface roughness of less than or equal to 1.25 μm Ra; said pressure roller comprises a metal core, and a fluoropolymer resin layer, said fluoropolymer resin layer has a thermal conductivity greater than 0.29 W/m°C. and a surface energy less than or equal to 20 dyne/cm.

20 Claims, No Drawings

METHOD OF INCREASING GLOSS AND TRANSPARENCY CLARITY OF FUSED TONER IMAGES

CROSS REFERENCE TO RELATED APPLICATION

Reference is made to and priority claimed from U.S. Provisional Application Ser. No. 60/003,552, filed 01 Aug. 1995, entitled METHOD OF INCREASING GLOSS AND TRANSPARENCY CLARITY OF FUSED TONER IMAGES.

FIELD OF THE INVENTION

This invention relates to a method of increasing the gloss and transparency clarity of fused toner images.

BACKGROUND OF THE INVENTION

Heat-softenable toners are widely used in imaging methods such as electrostatography, wherein electrically charged toner is deposited imagewise on a dielectric or photoconductive element bearing an electrostatic latent image. Most often in such methods, the toner is then transferred to a surface of another substrate, such as, e.g., a receiver comprising paper or a transparent film (transparency), where it is then fixed in place to yield the final desired toner image.

When heat-softenable toners, comprising, e.g., thermoplastic polymeric binders, are employed, the usual method of fixing the toner to the receiver involves applying heat to the toner on the receiver surface to soften the toner and then allowing or causing the toner to cool.

One such well-known fusing method comprises passing the toner-bearing receiver sheet through the nip formed by a pair of opposing rollers, at least one of which (usually referred to as a fuser roller) is heated and contacts the toner-bearing surface of the receiver in order to heat and soften the toner. The other roller (usually referred to as a pressure roller) serves to press the receiver sheet into contact with the fuser roller.

The fuser roller usually comprises a rigid core covered with a resilient material, which will be referred to herein as a "cushion layer." The resilient cushion layer and the amount of pressure exerted by the pressure roller serve to establish the area of contact of the fuser roller with the toner-bearing surface of the receiver as it passes between the pair of rollers. The area of contact of the two rollers is referred to as the nip, and the width of the area of contact between the two rollers is referred to as the nip width. The larger the nip width the longer the time, also referred to as the dwell time, that any given, portion of the toner image will be in contact with and heated by the fuser roller and pressure roller.

It has been previously disclosed that the gloss of a toner image can be increased by either increasing the fusing temperature or increasing the dwell time of the receiver within the fuser nip. Generally, increasing the fusing temperature or dwell time are not desireable, because the energy demands increase, the temperature within an electrostatographic machine increases to the detriment of other subsystems, and/or the production speeds of fused images decreases.

Anodized aluminum pressure rollers have been used to provide fused color images having high gloss and good transparency clarity; however, these rollers suffer from toner build-up and frequent paper jams.

Pressure rollers coated with fluoropolymer resin materials have been used to fuse single-color and multi-color images without excessive toner build-up or copy jams; however, these rollers provide lower gloss and transparency clarity than desired.

Accordingly, there is a need in the art for a method of fusing toner images which achieves both high gloss images and increased transparency clarity with little, if any, toner build-up on the pressure roller.

SUMMARY OF THE INVENTION

This invention provides a method of increasing the gloss value and/or transparency clarity of a fused toner image comprising the steps of:

a) applying toner to a receiver to create a toner bearing receiver; and b) passing the toner bearing receiver through a heated fuser system; wherein said heated fuser system consists of a fuser member and a pressure member; said fuser member has a surface roughness less than 1.25 μm Ra; said pressure member comprises a support, and a fluoropolymer resin layer, said fluoropolymer resin layer has a thermal conductivity greater than or equal to 0.29 W/m°C. (0.17 Btu/hrft°F.) and a surface energy less than or equal to 20 dyne/cm.

The inventors have discovered that by using a fuser member having the surface roughness specified and the thermally conducting pressure member, it is possible to produce fused toner images having increased gloss and transparency clarity. Additionally, the toner offset onto the pressure member in the method of this invention is limited, decreasing the number of paper jams. The advantages of this method apply to both black toner and multi-color toner systems although in a multi-color toner system the advantages are much more apparent.

DESCRIPTION OF THE PREFERRED EMBODIMENTS

This invention provides a method of increasing the gloss-value and the transparency clarity of fused toner images, particularly for color toner images, for example, cyan, magenta and yellow toner images. The method uses a fuser system, consisting of a pressure member and a fuser member. The gloss of a fused toner image is a measurement of light reflectance of the surface of the toner at a particular angle. Transparency clarity of a fused toner image on a transparency is a measurement of the dispersion of light passed through the transparency and fused color toners.

The fuser system in the method of this invention consists of a fuser member and a pressure member. The members can be rollers, plates or any other suitable shape that can establish pressurized and heated contact between the two members. In the preferred embodiment the fuser and pressure members are rollers. The description herein is primarily of the preferred fuser system consisting of a fuser roller and pressure roller; however, it is understood that the description applies to a fuser system of any configuration.

The fuser and pressure rollers are in pressurized contact and form a nip through which the toner bearing receiver is passed. At least one of the rollers in the fuser system is typically rotatably driven to cause the receiver to move through the fuser nip. The fuser roller preferably contacts the toner bearing side of the receiver. The fuser roller is heated either internally or externally. An internally heated fuser roller can be constructed with a heating coil inserted into the roller support or core; an externally heated fuser roller can be heated by contacting the outside surface of the fuser roller to another heated roller. The pressure roller does receive heat from the fuser roller; however, except for the heat it receives from the fuser roller, it is preferred that the pressure roller is not heated by an additional source.

In a simplex system the pressure roller preferably contacts the non-toner bearing side of the receiver. In a double pass duplex system the pressure roller preferably contacts the non-toner bearing side of the receiver or the already fused toner bearing side of the receiver. It is not preferred that the method of this invention be used in a single pass duplex system.

The fuser member usually comprises a rigid support. For a fuser roller, the support is a core, preferably a metal core. The fuser member is covered with a resilient material, also referred to as a cushion layer. Typically, for internally heated fuser rollers the thickness of the resilient material is between 1 and 5 mm. For externally heated fuser rollers, the cushion layer thickness is not as critical and cushions on the order of 8 mm or greater have been used. Cushion layer materials include, for example, silicone rubbers, fluoroelastomers, hydrocarbon rubbers, and fluorosilicone elastomers. Additional layers such as barrier layers or oil resistant top coat layers can be used. Examples of barrier layers or oil resistant top coat layers include fluorocarbon resins, fluoroelastomers and silicone rubbers. Any suitable configuration and composition of layers can be used on the fuser roller. If the fuser roller is internally heated these resilient materials typically contain heat conducting fillers to enhance thermal conductivity. Examples of such fillers include aluminum, aluminum oxide, zinc, zinc oxide, tin oxide, aluminum silicate, potassium silicate, mica, silicon carbide and tungsten carbide and others well known to a person of ordinary skill in the art. The fillers are usually from 8 to 40% of the total volume of the materials of the cushion layer and/or optional additional layer(s) to provide thermal conductivities of between 0.21 to 1.04 W/m°C.; preferably 0.35 to 0.87 W/m°C.

It is preferred that the fuser members used in the method of this invention are manufactured to achieve a surface roughness of less than or equal to 1.25 μm Ra, more preferably less than or equal to 1.0 μm Ra, most preferably less than or equal to 0.75 μm Ra. (Ra indicates roughness average). The surface roughness of the fuser member can be measured using a Federal Surface Analyzer, System 4000, having a sapphire chisel stylus with a radius of 10 μm. The smoothness of the surface of the fuser member is important, because the heat of the fuser system causes the toner to flow and to conform to the smooth surface of the fuser member which it contacts.

The characteristics of the resilient cushion layer and optional additional layers of the fuser roller, and the amount of pressure exerted by the pressure roller serve to establish the area of contact (nip) of the fuser roller with the toner-bearing surface of the receiver as it passes between the pair of rollers. The pressure in the nip is typically between 42,100 and 84,300 kg/m$^2$. The size of nip and the roller speeds establish the length of time that any given portion of the toner image will be in contact with and heated by the fuser roller. Silicone release oil, typically polydimethylsiloxane (PDMS) or mercapto functionalized PDMS, is usually applied to the fuser roller surface while it is in operation.

If the pressure roller described in the method of this invention is used in an existing fuser system with an existing smooth fuser roller and everything else in the system is not changed, for example the same toner, receivers, temperature, pressure, and dwell time are used, the fuser system will produce fused toner images having increased gloss and transparency clarity. The overall G85 gloss value of toner images, measured as described below, produced by the fuser system just described, usually will increase by 1, often by 5 as compared to the fused toner images made by the fuser system not using the pressure roller described in the method of this invention. The overall transparency clarity of color (e.g., cyan, magenta and yellow) toner images, measured as described below, produced by the method of this invention, usually will increase by 0.01, often by 0.05 as compared to the fused toner images not made by the method of this invention.

The pressure member consists of a non-compliant support, and a fluorocarbon resin layer possessing a thermal conductivity which is about 0.09 W/m°C., preferably 0.16 W/m°C. greater than the thermal conductivity of a fluorocarbon resin layer without thermally conductive fillers. The preferred support is a roller core, preferably metallic. Examples of suitable core materials include steel, aluminum, copper, and stainless steel.

The pressure roller has a fluorocarbon resin layer possessing a thermal conductivity greater than or equal to 0.29 W/m°C., preferably greater than or equal to 0.35 W/m°C., most preferably greater than or equal to 0.40 W/m°C. Examples of fluorocarbon resin materials include polytetrafluoroethylene (PTFE), polyperfluoroalkyl vinyl ether (PFA), polyfluoroethylenepropylene (FEP) and blends of the foregoing, preferably a blend of PTFE and PFA. These materials are commercially available from DuPont, Whitford and other companies. One preferred PTFE/PFA blend is believed to be primarily PTFE with a small amount, about 10 percent by weight PFA available as Supra SilverStone® from DuPont. The higher thermal conductivities can be achieved by adding fillers such as metal, metal oxide, and ceramic fillers. Specific examples of fillers include aluminum, aluminum oxide, zinc, zinc oxide, tin oxide, aluminum silicate, potassium silicate, mica, silicon carbide and tungsten carbide and others well known to a person of ordinary skill in the art. The preferred fillers are aluminum and aluminum oxide. Preferably, the fluorocarbon resin coating is applied to the core from an aqueous solution. The preferred ratio of fillers to the fluorocarbon resin in the solvent coating is approximately 1:1 to 1:2, most preferably 1:1. Typically, the solvent coating material is about 40 percent by weight solids.

The thickness of the pressure roller layer is preferably 0.025 mm to 0.125 mm, more preferably 0.025 mm to 0.075 mm. The surface roughness of the pressure roller is preferably from 0.5 μm to 2.5 μm Ra, more preferably 0.75 μm to 1.25 μm Ra. The pressure roller preferably has a coefficient of friction less than or equal to 0.1 at room temperature. The coefficient of friction was measured at room temperature on samples of the coating using the "Pin on Disk" method. The pin or stylus was a Deltronics Crystal Inc., ID No. NYAG-3000-01701, 3 mm diameter, Neodymium-doped YAG, Micro-optic-hemisphere. The pressure roller preferably has a wear rate of less than 0.013 mm using a Norman Abrader test at 1600 cycles, and 175° C. The surface energy of the pressure roller is preferably less than or equal to 20 dynes/cm, more preferably less than or equal to 18 dynes/cm, most preferably less than or equal to 17 dynes/cm. The surface energy was determined by contact angle measurements using a Rame-Hart Inc., NRL model A-100 contact angle goniometer.

The preferred composition for the pressure roller is an aluminum core having a thermally conductive fluorocarbon resin layer consisting of a blend of PTFE and PFA with thermally conducting fillers. The fluorocarbon resin layer consists of a primer coat and a top coat. The preferred primer consists of a 12 percent solids aqueous solution consisting of 6 percent PTFE/PFA blend and 6 percent aluminum oxide. The preferred top coat consists of a 40 percent solid aqueous solution consisting of a 20 percent PTFE/PFA blend, 4 percent aluminum oxide and 16 percent metallic aluminum. The most preferred material is a two layer coating produced by DuPont having the product designation numbers 855-032 and 855-132. The total thickness of the two-layer coating is preferably about 0.038 mm. The primer preferably has a thickness of about 0.007 mm. and the top coat preferably has a thickness of about 0.030 mm.

Any toner can be used in the method of this invention. The preferred toners for increasing transparency clarity are polyester toners, such as Eastman Kodak Company ColorEdge® toner. Any paper or transparency can be used in the method of this invention. The preferred paper is a smooth paper such as Hammermill 24 lb. Laser Print® paper, having a Sheffield smoothness of 50 to 60. The preferred transparencies are thin and heat distortion resistant transparencies, such as Eastman Kodak Company 555®.

The operating temperature of the fuser roller in the method of this invention is dictated by the characteristics of the fuser system, such as speed of the rollers and the materials used to make the fuser and pressure rollers and the flow characteristics of the toner. Preferably, the temperature of the fuser roller is between 160° C. and 200° C. The speed of the receiver through the fuser system is preferably 25 to 75 mm/sec. The gloss and transparency clarity produced by the method of this invention increase with decreasing receiver speed through the fuser system.

The application of toner onto the receiver to create a toner bearing receiver can be by any method known to a person of ordinary skill in the art. For example, the toner can be electrophotographically deposited onto the receiver using the well known steps of charging a photoconductive element, exposing the element to a light source to create an electrostatic latent image on the element, toning the latent image and transferring the toner from the element to a receiver brought into transfer relationship with the element.

The method of this invention provides increased gloss, and increased transparency clarity of a fused toner image and decreased offset of toner onto a pressure roller. The transparency clarity, specified herein is measured by shining white light directly through a transparency bearing fused color toner (cyan, magenta and yellow toner) and measuring the amount of light which passes through the toner and transparency at approximately 7.6 mm above the transparency and measuring the amount of light 40.6 cm above the transparency. The light collector was a disk-shaped United Detector Technology Collector, Serial No. 1613A having a 10.2 mm collector diameter. The light was shown through a 5.1 mm diameter aperature located next to the transparency and between the transparency and the light source. The light collector was parallel to the toner bearing surface of the transparency, and perpendicular to the light source at 7.6 mm and 40.6 cm -above the transparency, and the light collector was moved so that it was located directly above the same area of the transparency. These measurements need to be determined in a dark room or the amount of light collected has to be corrected for that measured from additional light sources. The transparency clarity is a ratio of the light collected at 40.6 cm divided by the light collected 7.6 mm above the image. The overall transparency clarity for a toned image is the average of at least 3 ratios measured in several toner areas on each transparency.

The overall gloss value is determined by measuring the amount of light reflected off a fused process black toner image at a specific angle measured from a line perpendicular to the surface of the image, divided by the amount of light introduced to the image at the same specific angle on the opposite side of the perpendicular line. The fused process black toner image consists of cyan, magenta and yellow toners. The angles off the perpendicular line at which the gloss measurements are commonly taken are 20°, 60° and 85°. The gloss is measured using a Gardner Micro-TRI-Gloss® 20-60-85 Glossmeter. The gloss measurements are taken in several areas on the toner image and the numbers are averaged to determine the overall Gardner gloss value for a toner image. The overall gloss values measured by the Gardner glossmeter are often reported as G next to the size of the angle at which the gloss was measured, that is, G20, G60 and G85.

The toner offset or hot release can be measured by any conventional technique. One technique is described in the example section.

In conventional systems the method of this invention can typically provide G20 and G85 values greater than or equal to 1.7 and 13.0 respectively, often even 3.0 and 25 and transparency clarities greater than or equal to 0.865, often greater than or equal to 0.875.

This invention is further described by reference to the following examples:

Example 1

Pressure rollers having various layers were substituted into a fuser system to determine the effect the pressure rollers would have on the gloss and transparency clarity of color images fused in the fuser system.

The fuser system consisted of an internally heated fuser roller. The fuser roller had a 43.2 mm diameter aluminum core covered with a 2.5 mm thick red rubber base cushion EC-4952 (Emerson Cummings), a 0.04 mm thick Viton A-35 (DuPont) barrier layer, and a 0.04 mm Silastic E (Dow Corning) top coat. The base cushion layer and the barrier layer were applied as described in Example 1 of U.S. Pat. No. 4,853,737, incorporated herein by reference. The additional Silastic E top coat was applied by ring-coating and cured by heating in a conventional oven at 4 hours ramp to 200° C. and maintained at 200° C. for 12 hours. The fuser roller had a surface roughness of 0.625 μm Ra.

The pressure roller was driven at 31.8 mm/sec for fusing toner images onto transparencies and 63.5 mm/sec for fusing toner images onto paper. The pressure roller had a core diameter of 40.6 mm. The toners used were Eastman Kodak Company ColorEdge® cyan, magenta and yellow toners. The maximum toner lay-down for the cyan, magenta and yellow toners was 2.1 milligrams/cm$^2$. The single-color toner lay down on the transparencies was 0.75 milligrams/cm$^2$. Silicone release oil, 350 cts PDMS from Dow Corning was applied to the fuser roller at a rate of 7 mg per copy. The nip width was 3.8 mm for a dwell time of 120 milliseconds for transparencies and 60 milliseconds for paper. The fuser roller was internally heated to provide a surface temperature of 190° C.

Pressure roller A, the thermally conductive pressure roller of the method of this invention, was prepared by the following method: The aluminum core was grit blasted with 80 mesh aluminum oxide at approximately $2.90\times10^5$N/m$^2$. A primer 855-032 available from DuPont was spray-coated and cured at 232° C. for 10.5 minutes to provide a dry thickness of about 6.75 μm. The top coat 855-132 available from DuPont was applied by spray-coating, and cured at 415° C. for 3 minutes to produce a dry thickness of about 30 μm. The total polymer layer thickness was 37.5 μm.

Comparative pressure rollers B and C, coated with fluorocarbon resins, Supra SilverStone® and SilverStone® available from DuPont, were prepared like pressure roller A except that an additional mid-coat was applied as described in the product literature. The Supra SilverStone® coating consisted of the product designation numbers 455-300, 855-401, and 855- 500. The SilverStone® coating consisted of the product designation numbers 850-321, 456-1215 and 456- 300.

Comparative pressure roller D, the anodized aluminum pressure roller, was a smaller version of the pressure roller of the ColorEdge® machine available from the Eastman Kodak Company.

Comparative pressure roller E, the tungsten carbide plasma coated pressure roller, was prepared by injecting tungsten carbide (PC915 supplied by Plasma Coatings, Inc.) into a plasma jet and depositing it onto an aluminum core.

The paper was Hammermill 20 lb. Bond. The transparencies were Eastman Kodak Company 555®, particularly suitable for the creation of transparencies having color images. The gloss, and transparency clarity were measured as described above. The hot release was measured by passing an already fused image through the heated fuser system. The toner image was magenta toner at a laydown of about 0.7 mg/cm$^2$in the shape of a triangle with the point of the triangle passing through the fuser first. The distance from the point of the triangle to where the image began to offset was measured. If the distance was greater than 7.5 cm, the hot release was considered good.

Table 1 lists the pressure roller materials, whether the surface energies are less than or equal to 20 dynes/cm, whether the thermal conductivities are greater than 0.29 W/m°C., whether the overall gloss-G20 of the fused toner images was greater than or equal to 1.70, whether the overall transparency clarity of the fused images was greater than or equal to 0.865, and whether the hot release or offset of toner onto the fuser roller was at a distance greater than 7.5 cm.

Table 1 indicates that only pressure rollers having the specified thermal conductivity and surface energy of the invention provide increased gloss and transparency clarity and good hot release (low toner offset).

TABLE 1

| Pressure Roller | Surface Energy ≦20 dynes/cm | Thermal Conductivity >0.29 W/m °C. | Gloss | Clarity | Hot Release |
|---|---|---|---|---|---|
| Example A-Thermally Conductive fluorocarbon resin | Yes | Yes | Higher | Higher | Good |
| Comparative B-Fluorocarbon resin | Yes | No | Lower | Lower | Good |
| Comparative C-Fluorocarbon resin | Yes | No | Lower | Lower | Good |
| Comparative D-Anodized Aluminum | No | Yes | Higher | Higher | Bad |
| Comparative E-Tungsten Carbide/Plasma | No | No | Lower | Lower | Good |

Example 2

Some of the overall transparency clarity and overall gloss values of fused toner images using different pressure rollers in the fuser system described in Example 1 are tabulated in Table 2.

Pressure roller A and Comparative pressure roller B were made as described in Example 1. Pressure roller A' was made in the same manner as Pressure roller A.

TABLE 2

| Material | Clarity | G20 | G85 |
|---|---|---|---|
| Example A-Thermally Conductive Resin | 0.874 ± 0.014 | 1.71 ± 0.19 | 13.66 ± 1.08 |
| Example A'-Thermally Conductive Resin | 0.875 ± 0.01 | | |
| Comparative B-Fluorocarbon Resin | 0.860 ± 0.011 | 1.49 ± 0.12 | 12.41 ± 0.75 |

Pressure rollers A and A1, used in the method of this invention provided the highest gloss and transparency clarity values.

Example 3

Pressure roller A, the thermally conductive fluorocarbon resin pressure roller prepared in Example 1, was used with a fuser roller similar to the one described in Example 1 except the Viton A-35 barrier layer had 35 volume percent aluminum oxide incorporated into it, the top coat was Silastic® J (Dow Corning) and the fuser roller had a surface roughness of 0.5 μm Ra. The same set points i.e., nip width and speed, of the fuser system in Example 1 were used in this example except as indicated in Table 3. The same toners, toner lay-down and paper indicated in Example 1 were used in this example.

Overall Gardner gloss values at 20° and 85° angles from the surface of the fused toner on the paper were measured as described above and tabulated in Table 3.

TABLE 3

| Dwell Time (milli sec) | Fuser Roll Temp. (°C.) | G20 | G85 |
|---|---|---|---|
| 50 | 177 | 1.13 | 22.70 |
| 50 | 204 | 3.07 | 42.29 |
| 60 | 190 | 3.04 | 43.70 |
| 70 | 177 | 2.29 | 37.40 |
| 70 | 204 | 7.76 | 54.30 |

Table 3 indicates the high gloss values which can be obtained by the method of this invention.

What is claimed is:

1. In a method fusing a toner image comprising the steps of:

a) applying toner to a receiver to make a toner bearing receiver; and b) passing said toner bearing receiver through a heated fuser system to create a fused toner image on a receiver; said heated fuser system consisting of a fuser roller and a pressure member; the improvement wherein said fuser roller has a surface roughness of less than or equal to 1.25 μm Ra; said pressure member comprises a support, and a fluoropolymer resin layer, said fluoropolymer resin layer having conductive fillers, a thermal conductivity greater than or equal to 0.29 W/m° C. and a surface energy less than or equal to 20 dyne/cm.

2. The method of claim 1 wherein said fuser roller (member) is heated.

3. The method of claim 1, wherein said fused toner image has an overall Gardner gloss value at an 85° angle (G85) of greater than or equal to 13.

4. The method of claim 1, wherein said fused toner image has an overall Gardner gloss value at an 85° angle (G85) from the receiver of greater than or equal to 25.

5. The method of claim 1, wherein said fused toner image has an overall Gardner gloss value at a 20° angle (G20) from the receiver of greater than or equal to 1.7.

6. The method of claim 1, wherein said fused toner image has an overall Gardner gross value at a 20° angle (G20) from the receiver of greater than or equal to 3.0.

7. The method of claim 1, wherein said fused toner image has an overall transparency clarity greater than or equal to 0.865.

8. The method of claim 1, wherein said fused toner image has an overall transparency clarity greater than or equal to 0.875.

9. The method of claim 1 wherein said fuser roller has a surface roughness less than or equal to 1 μm Ra.

10. A method of increasing the gloss value of a fused toner image comprising the steps of:

a) applying toner to a receiver to make a toner bearing receiver; and b) passing the toner bearing receiver through a heated fuser system to create a fused toner image on a receiver; wherein said heated fuser system consists of a fuser roller and a pressure roller; said fuser roller has a surface roughness of less than or equal to 0.75 μm Ra; said pressure roller comprises a metal core, and a fluoropolymer resin layer, said fluoropolymer resin layer has conductive fillers, a thermal conductivity greater than or equal to 0.35 W/m° C. and a surface energy less than or equal to 20 dyne/cm.

11. The method of claim 11 wherein said pressure roller has a surface roughness between 0.5 and 2.5 μm Ra.

12. The method of claim 11 wherein said fluoropolymer resin layer of said pressure roller comprises polyfluoroalkylvinylether and filler.

13. The method of claim 10 wherein said pressure roller has a surface roughness between 0.75 and 1.25 μm Ra.

14. The method of claim 10 wherein said fluoropolymer resin layer of said pressure roller further comprises polytetrafluoroethylene and filler.

15. The method of claim 10 wherein said fluoropolymer resin layer of said pressure roller comprises polyfluoroethylenepropylene and filler.

16. The method of claim 10 wherein said fluoropolymer resin layer of said pressure roller comprises a mixture of polytetrafluoroethylene, polyfluoroalkylvinylether, and filler.

17. The method of claims 1 or 16 wherein said filler is selected from the group consisting of aluminum, aluminum oxide and a mixture of aluminum and aluminum oxide.

18. The method of claim 17, wherein said core of said pressure roller is aluminum.

19. The method of claim 18, wherein said fuser roller comprises a polydimethylsiloxane top coat.

20. In a method fusing a toner image comprising the steps of:

a) applying toner to a receiver to make a toner bearing receiver; and b) passing said toner bearing receiver through a heated fuser system to create a fused toner image on a receiver; said heated fuser system consisting of a fuser roller and a pressure roller; the improvement wherein said fuser roller has a surface roughness of less than or equal to 1.25 μm Ra; said pressure roller comprises a support, and a fluoropolymer resin layer, said fluoropolymer resin layer comprising conductive filler and having a thermal conductivity greater than or equal to 0.29 W/m°C. and a surface energy less than or equal to 20 dyne/cm.

* * * * *